US007383106B1

(12) United States Patent
Coonse, Jr.

(10) Patent No.: US 7,383,106 B1
(45) Date of Patent: Jun. 3, 2008

(54) ACTIVE NOISE CONTROL SYSTEM FOR AIRCRAFT, AND METHOD FOR ENHANCING PILOT SITUATIONAL AWARENESS

(76) Inventor: Lester C. Coonse, Jr., 71 Pinewood Rd., Granite Falls, NC (US) 28630

( * ) Notice: Subject to any disclaimer, the term of this patent is extended or adjusted under 35 U.S.C. 154(b) by 125 days.

(21) Appl. No.: 11/141,279

(22) Filed: May 31, 2005

(51) Int. Cl.
*G10K 9/00* (2006.01)

(52) U.S. Cl. ..... 701/10; 381/367

(58) Field of Classification Search ..... 701/10; 381/71.2, 73.1, 322, 328, 317, 367, 354, 381/353, 26, 94.1, 74.1
See application file for complete search history.

(56) References Cited

U.S. PATENT DOCUMENTS 4,654,871 A * 3/1987 Chaplin et al. ..... 381/72
4,715,559 A * 12/1987 Fuller ..... 244/1 N
6,031,917 A * 2/2000 Mathur ..... 381/71.11
6,118,878 A * 9/2000 Jones ..... 381/72
2003/0228019 A1* 12/2003 Eichler et al. ..... 381/71.8
2006/0238877 A1* 10/2006 Ashkenazi et al. ..... 359/630

FOREIGN PATENT DOCUMENTS

EP 1170976 A1 * 1/2002

* cited by examiner

*Primary Examiner*—Dalena Tran
(74) *Attorney, Agent, or Firm*—Schwartz Law Firm, P.C.

(57) ABSTRACT

An active noise control system for aircraft includes a headset for use by a pilot of the aircraft. A plurality of sensors are mounted on the aircraft at predetermined locations to sense aircraft noise. The aircraft noise at each of the sensors has a first sound waveform in a first phase. A plurality of actuators are operatively connected to respective sensors and communicate with the headset. Each actuator generates a second sound waveform in a second phase. A controller commands each of the plurality of actuators, and dictates the second phase of the second sound waveform, such that the first and second sound waveforms interact out of phase in a manner sufficient to control the aircraft noise. The controlled aircraft noise enables auditory detection of remote environmental disturbances outside of the aircraft thereby enhancing pilot sensory awareness.

20 Claims, 5 Drawing Sheets

ACTIVE NOISE CONTROL SYSTEM FOR AIRCRAFT, AND METHOD FOR ENHANCING PILOT SITUATIONAL AWARENESS

TECHNICAL FIELD AND BACKGROUND OF THE INVENTION

This application relates to an active noise control system for aircraft, and a method for enhancing pilot situational awareness. The term "active noise control" refers broadly herein to any active, adaptive, or semi-active means for controlling, cancelling, damping, or suppressing any noise, sound, vibration, structural-acoustic, or vibro-acoustic. The invention utilizes the pilot's auditory sense to enhance situational awareness. In the present context, situational awareness is the degree of accuracy by which a pilot's perception of his or her current environment mirrors reality. At all times during a flight, the pilot should know where he has been, where he is, where he is going, and what he should be doing.

A number of tools are available to assist in developing and maintaining situational awareness. Checklists, for example, provide excellent outlines intended to guide pilots through problems in a methodical way, and ultimately, ease the strain on situational awareness. In today's panoramic glass cockpits, other more technological tools include multi-color moving map displays. Such visual displays can play a big role in enhancing situational awareness by lessening certain cognitive tasks—e.g., keeping track of where you are and where you are going. However, because the brain can only handle a certain amount of work at any particular moment, the abundance of checklists, maps, gauges, and other visual tools often cause task overload. When the brain's processing limits are exceeded, things get overlooked and, regrettably, situational awareness begins to rapidly decompose.

One key object of the present invention is to reduce reliance on existing visual tools by better utilizing the pilot's sense of hearing for enhanced situational awareness. By employing strategically located noise controllers on the aircraft, the existence of other nearby aircraft can be readily communicated to the pilot with no additional cockpit visual work load. The invention promotes collision avoidance by making the pilot clearly aware of the presence and relative position of other nearby aircraft in real time while looking out the windscreen of the cockpit. Nearby aircraft to the right and left, above, behind, and below are readily detected even though they may not be directly visible to the pilot.

SUMMARY OF INVENTION

Therefore, it is an object of the invention to provide an active noise control system for aircraft.

It is another object of the invention to provide a method for enhancing pilot situational awareness.

It is another object of the invention to provide a supplement to other collision avoidance systems in the airport traffic area where most collisions have historically occurred.

It is another object of the invention to provide a collision avoidance system which effectively utilizes the pilot's sense of hearing.

It is another object of the invention to enhance pilot situational awareness by utilizing the sound of the detected aircraft.

It is another object of the invention to enhance pilot situational awareness by utilizing sound to determine position and moving direction of the detected aircraft.

It is another object of the invention to enhance pilot situational awareness by detecting nearby aircraft using sound Doppler shift to determine when the detected aircraft is no longer a collision threat.

It is another object of the invention to provide a collision avoidance system which adds no visual workload to the pilot.

It is another object of the invention to provide a collision avoidance system which allows pilots to detect and avoid or find surveillance drones which normally would be invisible to conventional transponder and radar detection systems.

It is another object of the invention to enhance pilot sensory awareness by electronically cancelling the sound of the equipped aircraft in the pilot's headset leaving only the sounds of nearby aircraft.

It is another object of the invention to enhance pilot sensory awareness by enabling the pilot to get directional information of nearby aircraft naturally as he would if he were standing in the stillness of the air without his aircraft noise.

It is another object of the invention to provide a collision avoidance safety enhancement which is applicable to both civilian and military aircraft.

These and other objects of the present invention are achieved in the preferred embodiments disclosed below by providing an active noise control system for aircraft. The noise control system includes a headset for use by a pilot of the aircraft. A plurality of sensors are mounted on the aircraft at predetermined locations to sense aircraft noise. The aircraft noise at each of the sensors has a first sound waveform in a first phase. A plurality of actuators are operatively connected to respective sensors and communicate with the headset. Each actuator generates a second sound waveform in a second phase. A controller commands each of the plurality of actuators, and dictates the second phase of the second sound waveform, such that the first and second sound waveforms interact out of phase in a manner sufficient to control the aircraft noise. The controlled aircraft noise enables auditory detection of remote environmental disturbances outside of the aircraft thereby enhancing pilot sensory awareness.

According to another preferred embodiment of the invention, the plurality of sensors include respective microphones for converting the first sound waveform into electrical signals.

According to another preferred embodiment of the invention, the plurality of actuators include respective loudspeakers receiving the electrical signal from the microphones, and cooperating with the controller to generate each of the second sound waveforms.

According to another preferred embodiment of the invention, the controller is a digital signal processor.

According to another preferred embodiment of the invention, the controller is an analog controller.

In another embodiment, the invention is an improved aircraft including a cockpit, opposing wings, and a fuselage. The improvement relates to an active noise control system including a headset for use by a pilot in the cockpit of the aircraft. A plurality of sensors are mounted on the aircraft at predetermined locations to sense aircraft noise. The aircraft noise at each of the sensors has a first sound waveform in a first phase. A plurality of actuators are operatively connected to respective sensors and communicate with the headset. Each actuator generates a second sound waveform in a second phase. A controller commands the plurality of actuators and dictates the second phase of the second sound waveform, such that the first and second sound waveforms interact out of phase in a manner sufficient to control aircraft noise communicated through the headset to the pilot. The controlled aircraft noise enables auditory detection of remote environmental disturbances outside of the aircraft thereby enhancing pilot sensory awareness.

According to another preferred embodiment of the invention, the plurality of sensors includes first and second wing sensors fixedly attached outside of the aircraft on respective wings.

According to another preferred embodiment of the invention, the plurality of sensors includes at least one fuselage sensor fixedly attached outside of the aircraft in an area of the fuselage.

According to another preferred embodiment of the invention, the plurality of sensors includes top and bottom fuselage sensors fixedly attached outside of the aircraft on a top and bottom side of the fuselage.

In yet another embodiment, the invention is a method for enhancing pilot situational awareness in an aircraft. The method includes the step of providing a remote disturbance indicator inside a cockpit of the aircraft. A plurality of sensors are mounted on the aircraft at predetermined locations to sense aircraft noise. The aircraft noise at each of the sensors has a first sound waveform in a first phase. A plurality of actuators are operatively connected to respective sensors. Each actuator generates a second sound waveform in a second phase. The second phase of the second sound waveform is dictated, such that the first and second sound waveforms interact out of phase in a manner sufficient to control the aircraft noise. When the aircraft noise is controlled, a remote environmental disturbance outside of the aircraft can be readily detected. Once detected, a signal is transmitted to the remote disturbance indicator inside the cockpit to alert the pilot of the detected environmental disturbance.

According to another preferred embodiment of the invention, the remote disturbance indicator is a visual indicator.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
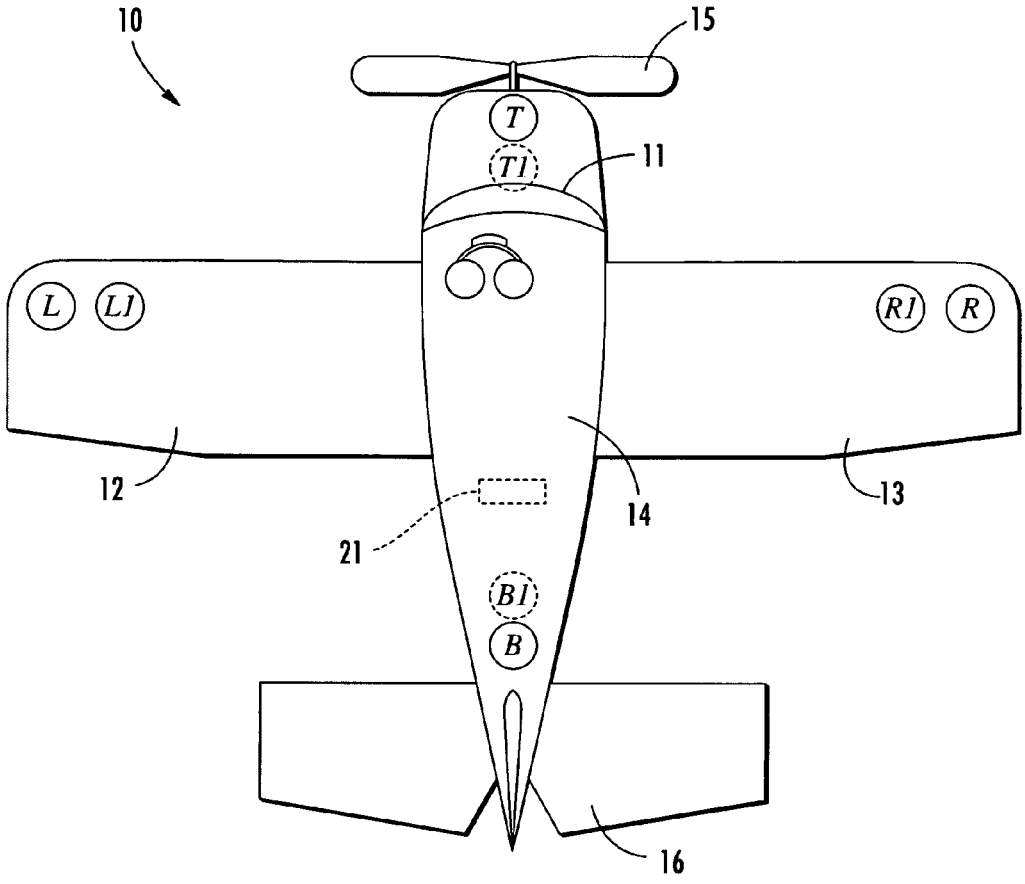
FIG. 1 is a plan view of an aircraft equipped with a noise control system according to one embodiment of the present invention.

Referring now specifically to the drawings, a conventional aircraft incorporating an active noise control system according to the present invention is illustrated in FIG. 1, and shown generally at reference numeral 10. The aircraft comprises a cockpit 11, wings 12 and 13, fuselage 14, engine (not shown), rotor 15, and tail assembly 16. A number of paired sensors T&T1, B&B1, L&L1, and R&R1 are mounted on the aircraft 10 at a top side of the fuselage 14 proximate the rotor 14, left wing 12, right wing 13, and underside of the fuselage 14 proximate the tail assembly 16, respectively. The sensors of each pair T&T1, B&B1, L&L1, R&R1 face in opposite directions with one facing inwardly toward the aircraft 10 and the other facing outwardly away from the aircraft 10. The sensors are preferably microphones, accelerometers, or other devices applicable for detecting sound waves.

Figure 2:
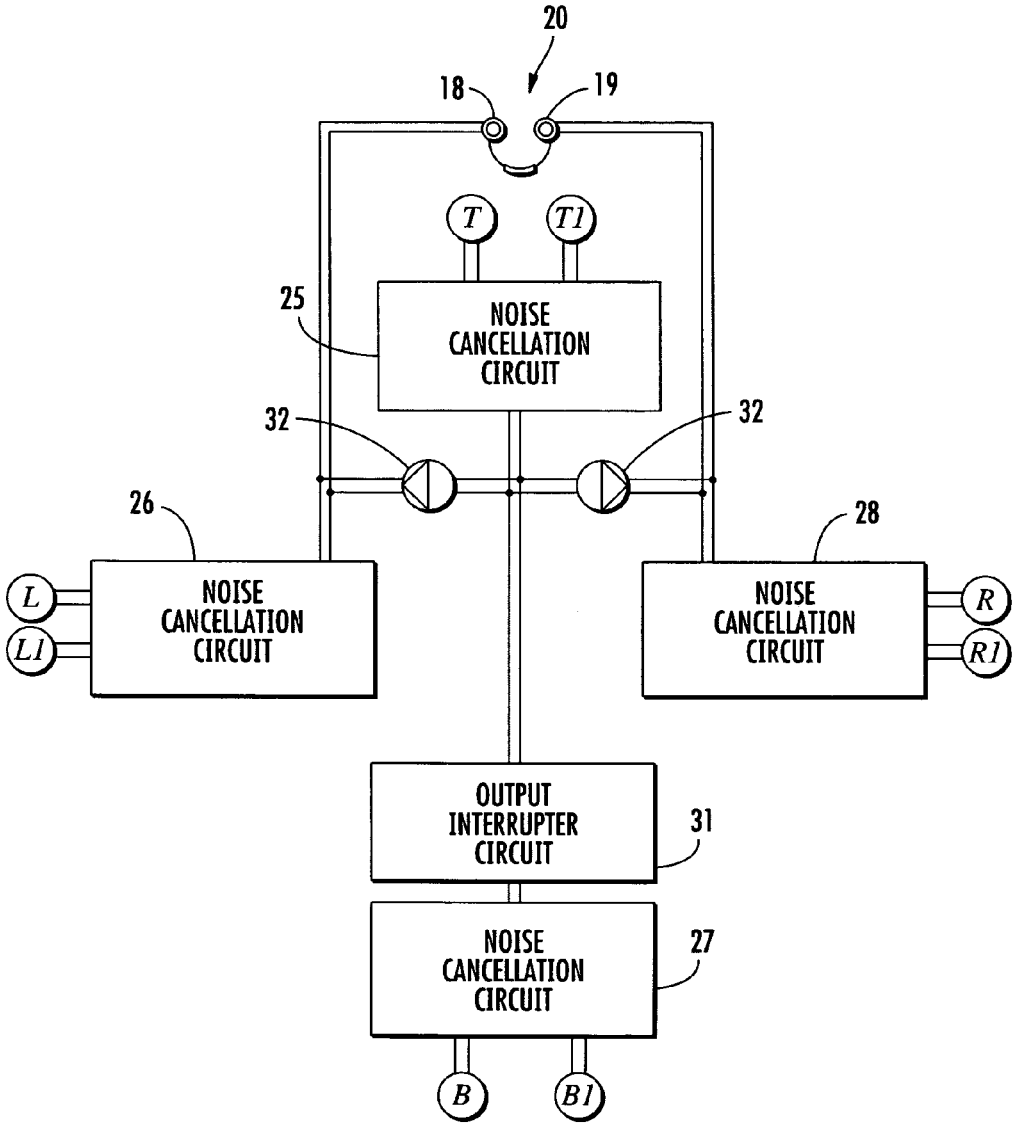
FIG. 2 is a schematic diagram of the noise control system.

In this embodiment, the paired sensors T&T1, B&B1, L&L1, R&R1 detect aircraft noise in a first sound waveform, and convert the waveform to electrical signals which are fed to speakers 18, 19 in a pilot headset 20. An onboard microprocessor 21 directs the speakers 18, 19 to put the recorded signal exactly out of phase with the actual aircraft noise detected by the sensors T&T1, B&B1, L&L1, R&R1, such that the second sound waveform from the headset 20 is just the same and as loud as the noise (first sound waveform), but completely out of phase with the noise, thus canceling the first sound waveform and leaving only the sounds of nearby aircraft. FIG. 2 is a schematic illustrating the various noise cancellation circuitry 25, 26, 27, and 28. An output interrupter circuit 31 causes intermittent sound indicating traffic below the aircraft 10. Preferably, signal filters 32 are used to prevent sound crossover from one speaker to the next.

The microprocessor 21 is programmed to cancel signal pairs which are common to the paired sensors T&T1, B&B1, L&L1, R&R1 and to keep newer/uncommon signals from the outward facing sensors. This newer/uncommon signal is the sound of nearby aircraft or other remote disturbance, and is sent to the pilot headset 20 differentially according to sensor location (e.g., right or left wingtip, topside, or underside). This further enhances the noise cancellation effect and allows the pilot to hear the exact presence and direction of the nearby aircraft in time to evaluate its collision threat and to take any necessary evasive action. The microprocessor 21 could also refresh the model of ambient sound at some predetermined, timed interval. Doing so would correct for changes in the ambient sound caused by changes in aircraft altitude, power setting, rain, etc.

Figure 3:
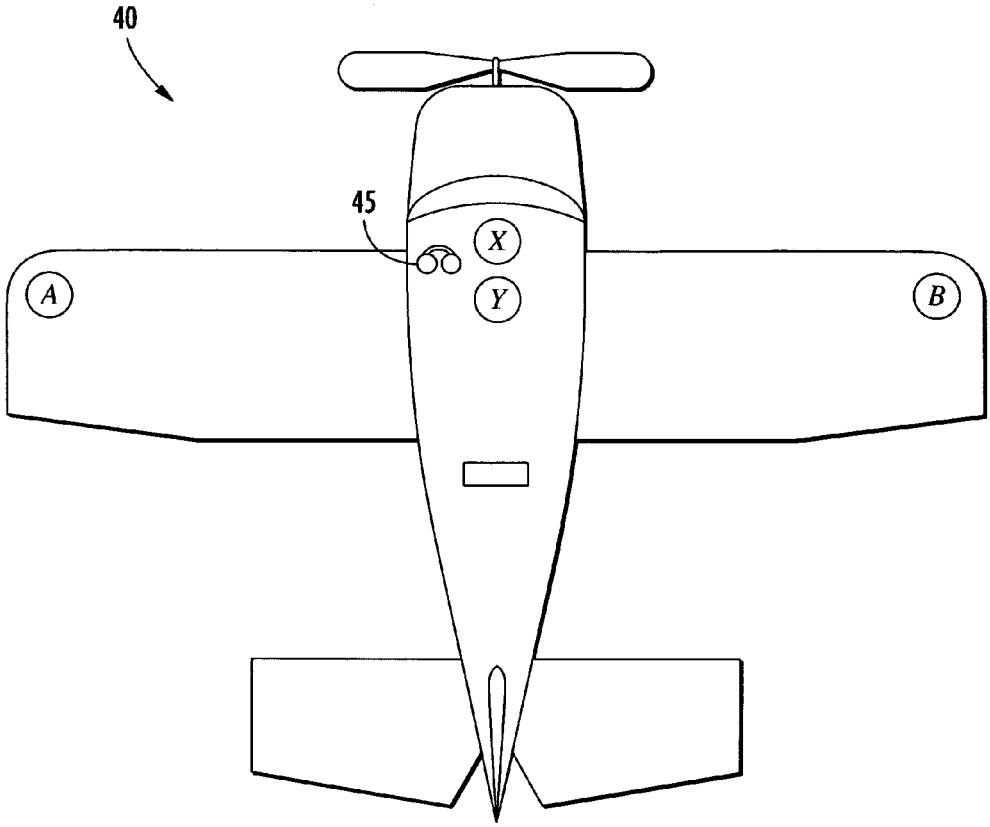
FIG. 3 is a plan view of an aircraft equipped with a noise control system according to a second embodiment of the present invention.
Figure 4:
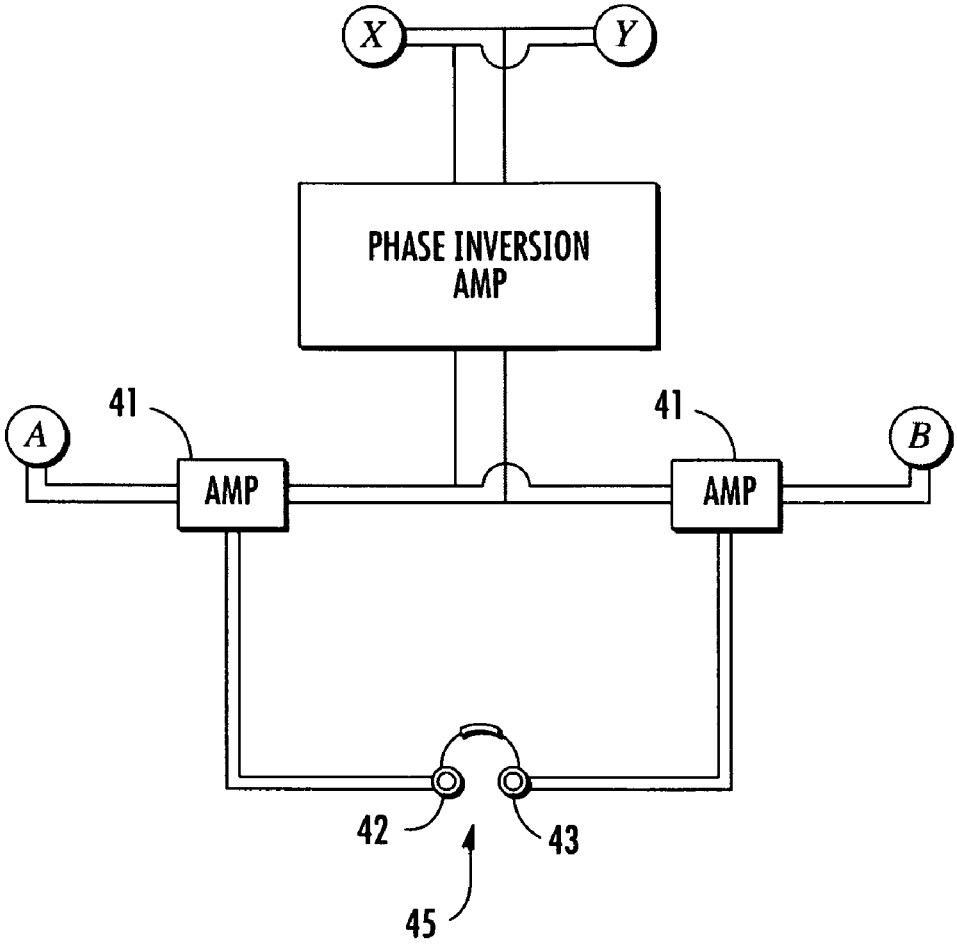
FIG. 4 is a schematic diagram of the noise control system of FIG. 3.

An embodiment of an aircraft 40 incorporating a noise control system utilizing an analog connection is shown in FIGS. 3 and 4. The paired sensors A, B, X, and Y on each of the wings and on the top and bottom sides of the fuselage, respectively, are connected to respective paired amplifiers 41, one being out of phase with the other. The sensors A, B, X, Y and amplifiers 41 of each pair face in opposite directions towards and away from the aircraft 40. As previously described, the sensors A, B, X, Y detect aircraft noise in a first sound waveform, and convert the waveform to electrical signals which are fed to speakers 42, 43 in a pilot headset 45. The electrical signals are adjusted so that the signal from the outward facing amplifiers 41 exactly cancels the sound of the inward facing sensors A, B, X, Y (first waveforms) with opposite phase but equal amplitude second waveforms. This has the effect to cancel the sound of the equipped aircraft 40. Sounds from nearby aircraft, when present, will shift this balance of signal so that only the nearby aircraft becomes audible. The sound from nearby aircraft will reach one set of paired microphones before reaching the other pairs, thus giving the pilot the ability to hear the nearby aircraft and also know its general direction.

Figure 5:
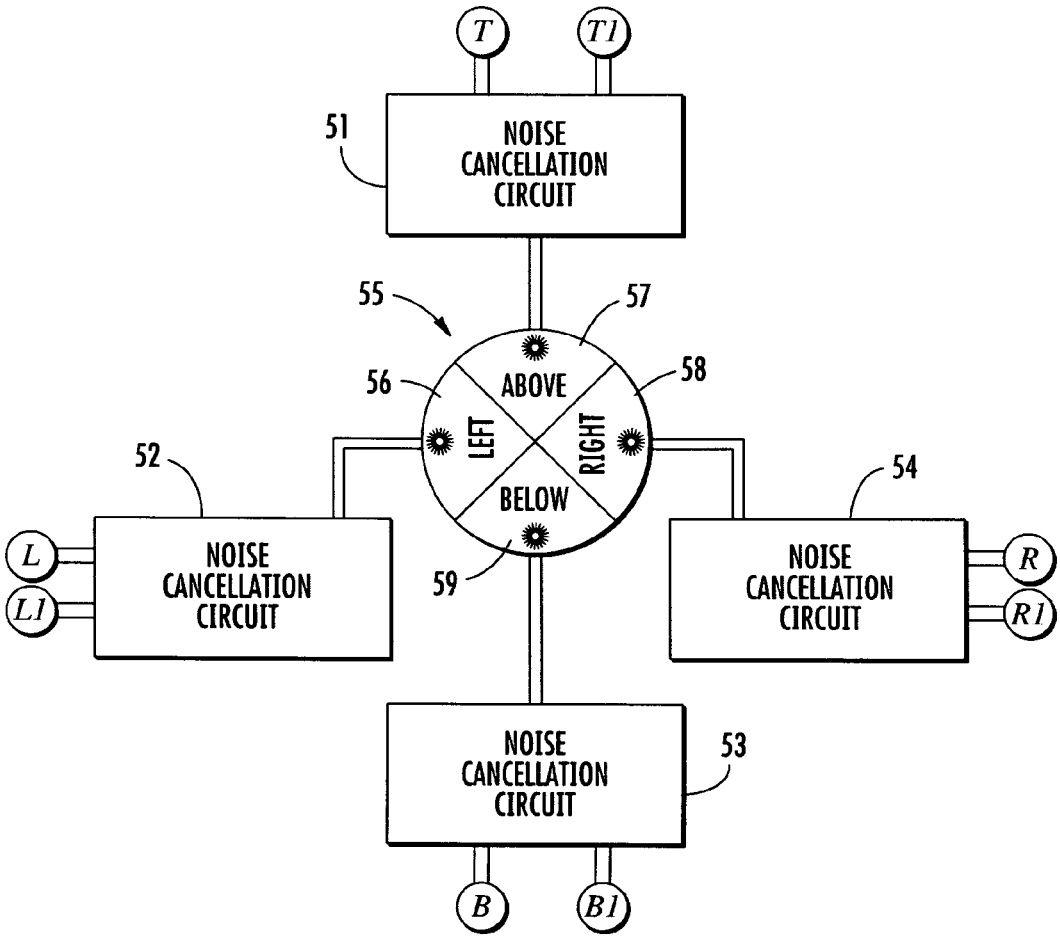
FIG. 5 is a schematic diagram of an aircraft noise control system according to yet another embodiment of the present invention.

Yet another embodiment of the invention is illustrated in FIG. 5. The aircraft (not shown) of this embodiment incorporates a number of pair sensors T&T1, B&B1, L&L1, and R&R1 mounted on a top side of the fuselage proximate the rotor, left wing, right wing, and underside of the fuselage proximate the tail assembly, respectively. The respective paired sensors T&T1, B&B1, L&L1, R&R1 face opposite directions with one facing inwardly toward the aircraft and the other facing outwardly away from the aircraft. A suitable controller and speakers (not shown) cooperate to generate corresponding sound waveforms out of phase with those detected by the sensors T&T1, B&B1, L&L1, R&R1 to cancel the aircraft noise. Aircraft traffic or other remote disturbance shifts the balance of a designated circuit 51, 52, 53, or 54, thereby signaling a visual cockpit indicator 55. The indicator 55 illuminates a directional LED 56, 57, 58, or 59 which alerts the pilot of the presence and direction of the nearby aircraft. Alternatively, the indicator 55 may further comprise an auditory alarm which sounds upon activation of the directional LED.

An active noise control system for aircraft, and a method for enhancing pilot situational awareness are described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. An active noise control system for aircraft, comprising:

a headset for use by a pilot of the aircraft;

a plurality of exterior aircraft sensor pairs for mounting on an exterior of the aircraft at predetermined locations, each sensor pair comprising a first sensor for facing inwardly towards the aircraft to sense aircraft noise and a second sensor for facing outwardly away from the aircraft to sense outside environmental noise other than aircraft noise, the aircraft noise at each of said first sensors comprising a first sound waveform in a first phase;

a plurality of actuators operatively connected to respective sensor pairs and communicating with said headset, each of said actuators generating a second sound waveform in a second phase;

a controller commanding said plurality of actuators and dictating the second phase of said second sound waveform, such that the first and second sound waveforms interact out of phase in a manner sufficient to control the aircraft noise generated by the aircraft, whereby the controlled aircraft noise enables auditory detection of the outside environmental noise sensed by the second sensors of said plurality of sensor pairs thereby enhancing pilot sensory awareness.

2. An active noise control system according to claim 1, wherein said first sensors of said plurality of sensor pairs comprise respective microphones for converting the first sound waveform into electrical signals.

3. An active noise control system according to claim 2, wherein said plurality of actuators comprise respective loudspeakers receiving the electrical signal from said microphones, and cooperating with said controller to generate the second sound waveform.

4. An active noise control system according to claim 1, wherein said controller comprises a digital signal processor.

5. An active noise control system according to claim 1, wherein said controller comprises an analog controller.

6. In an aircraft comprising a cockpit, opposing wings, and a fuselage, the improvement comprising an active noise control system, said noise control system comprising:

a headset for use by a pilot in the cockpit of said aircraft;

a plurality of exterior aircraft sensor pairs mounted on an exterior of the aircraft at predetermined locations, each sensor pair comprising a first sensor facing inwardly towards the aircraft to sense aircraft noise and a second sensor facing outwardly away from the aircraft to sense outside environmental noise other than aircraft noise, the aircraft noise at each of said first sensors comprising a first sound waveform in a first phase;

a plurality of actuators operatively connected to respective sensor pairs and communicating with said headset, each of said actuators generating a second sound waveform in a second phase;

a controller commanding said plurality of actuators and dictating the second phase of said second sound waveform, such that the first and second sound waveforms interact out of phase in a manner sufficient to control aircraft noise communicated through the headset to the pilot, whereby the controlled aircraft noise enables auditory detection of the outside environmental noise sensed by the second sensors of said plurality of sensor pairs thereby enhancing pilot sensory awareness.

7. An aircraft according to claim 6, wherein said first sensors of said plurality of sensor pairs comprise respective microphones for converting the first sound waveform into electrical signals.

8. An aircraft according to claim 7, wherein said plurality of actuators comprise respective loudspeakers receiving the electrical signal from said microphones, and cooperating with said controller to generate the second sound waveform.

9. An aircraft according to claim 6, wherein said controller comprises a digital signal processor.

10. An aircraft according to claim 6, wherein said controller comprises an analog controller.

11. An aircraft according to claim 6, wherein said plurality of sensor pairs comprise first and second wing sensor pairs fixedly attached outside of said aircraft on respective wings.

12. An aircraft according to claim 6, wherein said plurality of sensor pairs comprises at least one fuselage sensor pair fixedly attached outside of said aircraft in an area of the fuselage.

13. An aircraft according to claim 6, wherein said plurality of sensor pairs comprises top and bottom fuselage sensor pairs fixedly attached outside of said aircraft on a top and bottom side of the fuselage.

14. A method for enhancing pilot situational awareness in an aircraft, comprising the steps of:

providing a remote disturbance indicator inside a cockpit of the aircraft;

mounting a plurality of exterior aircraft sensor pairs on an exterior of the aircraft at predetermined locations, each sensor pair comprising a first sensor facing inwardly towards the aircraft to sense aircraft noise and a second sensor facing outwardly away from the aircraft to sense outside environmental noise other than aircraft noise, the aircraft noise at each of the first sensors comprising a first sound waveform in a first phase;

operatively connecting a plurality of actuators to respective sensor pairs, each of the actuators generating a second sound waveform in a second phase;

dictating the second phase of the second sound waveform, such that the first and second sound waveforms interact out of phase in a manner sufficient to control the aircraft noise;

when the aircraft noise is controlled, detecting the outside environmental noise sensed by the second sensors of the plurality of sensor pairs; and transmitting a signal to the remote disturbance indicator inside the cockpit to alert the pilot of the detected outside environmental noise.

15. A method for enhancing pilot situational awareness according to claim 14, wherein the remote disturbance indicator comprises an auditory indicator.

16. A method for enhancing pilot situational awareness according to claim 14, wherein the remote disturbance indicator comprises a visual indicator.

17. A method for enhancing pilot situational awareness according to claim 14, wherein the step of mounting a plurality of sensor pairs comprises locating microphones outside of the aircraft on opposing wings and a fuselage of the aircraft.

18. A method for enhancing pilot situational awareness according to claim 14, wherein the step of dictating the second phase of the second sound waveform comprises utilizing a digital signal controller for commanding the actuators.

19. A method for enhancing pilot situational awareness according to claim 14, wherein the step of dictating the second phase of the second sound waveform comprises utilizing an analog controller for commanding the actuators.

20. A method for enhancing pilot situational awareness according to claim 14, wherein the plurality of actuators comprise loudspeakers.

* * * * *